United States Patent [19]

Stanton

[11] 4,429,875

[45] Feb. 7, 1984

[54] GOLF CLUB

[76] Inventor: Robert Stanton, Rte. 44, Millbrook, N.Y. 12545

[21] Appl. No.: 429,065

[22] Filed: Sep. 30, 1982

[51] Int. Cl.[3] ..... A63B 53/12

[52] U.S. Cl. ..... 273/81.2; 273/80.1; 403/299; 403/343

[58] Field of Search ..... 273/81.2, 80 D, 80.1, 273/77 R, 77 A, 162 E, 80 R, 80 A, 80 B, 80 C; 403/299, 343

[56] References Cited

U.S. PATENT DOCUMENTS

| | | | |
|---|---|---|---|
| 2,475,927 | 7/1949 | Verderber | 273/80 D |
| 3,214,169 | 10/1965 | Rupnow | 273/80 D |
| 3,539,185 | 11/1970 | Andis | 273/81.2 |
| 3,687,499 | 8/1972 | Guilfoyle | 273/81.2 |

*Primary Examiner*—George J. Marlo

[57] ABSTRACT

A golf club adapted for assembly/dissassembly includes a cylindrical coupler with a lower part inserted permanently in the lower hollow shaft and which has a shoulder abutting the top of the lower shaft. The upper part of the coupler has internal threading cooperating with external threads on a solid shaft inserted in the upper hollow shaft. A projection on the upper part of the coupler cooperates with a cut-out in the upper hollow shaft to provide alignment of the grip and head of the club when the solid shaft is screwed into the coupler by using a knob or shoulder on the upper end of the solid shaft that tightens against the grip.

4 Claims, 4 Drawing Figures

GOLF CLUB

TECHNICAL FIELD

This invention relates to golf culbs, and more particularly to a putter construction including a coupler between upper and lower portions of a hollow shaft providing for assembly and disassembly of the putter while maintaining alignment between the grip and head of the putter.

BACKGROUND ART

Many golfers find it desirable to be able to transport or store a golf culb, and in particular a putter, for the purpose of practicing their putting stroke on a floor. While traveling, it would be desirable to be able to dissassemble a putter to approximately one-half its length to provide the ability to pack the club in a suit case. It might also be desirable to be able to assemble and dissassemble a putter to provide a smaller overall length when it is desirable to package the putter with other golf equipment such as the golf putting training device disclosed in U.S. Pat. No. 4,194,648.

Manufacture of a putter that can be assembled or dissassembled would normally require special construction for a lower portion of the hollow shaft and the upper portion of the hollow shaft for creating cooperating mechanisms to provide for the assembly and dissassembly of the club. Most of the assembly and dissassembly mechanisms known to the inventor include constructions which require rotary or twisting motion between the upper and lower portions of the hollow shaft. The shafts are normally of relatively light construction and in continued use requiring a twisting or turning motion, the shafts become worn and do not provide a solid connection. Further, most grips of golf clubs, including putters, include a deformation known as a grip reminder, and are created to provide a particular alignment between the grip and the head of the putter. Continued use of known coupling techniques provide a wearing between the upper and lower portions of the shaft whereby the alignment desired is no longer possible.

SUMMARY OF INVENTION

The present invention provides a coupling mechanism for tubular sections which maintains alignment between upper and lower portions of the tubular sections. Also provided by the present invention is a means for coupling upper and lower portions of a tubular shaft which requires only longitudinal motion between the upper and lower portions of the shaft. The coupling mechanism of the present invention is readily adapted for use in a construction process whereby a complete hollow shaft can be created, separated, and the coupling mechanism easily incorporated into the separated portions to provide for assembly and dissassembly while maintaining a predetermined alignment.

These features of a golf culb that can be assembled and dissassembled are realized by a coupling mechanism that includes a cylindrical plug having a lower part with an outer diameter essentially the same as the inside diameter of the hollow shaft of the lower section of the club which includes the putting head. An upper part of the cylindrical plug includes internal threading. The upper part of the cylindrical plug allows for relatively easy longitudinal motion of the upper portion of the hollow shaft over the upper part of the cylindrical plug.

Also included, and integral with the cylindrical plug, is a shoulder portion having opposite surfaces which ultimately abut against the ends of the lower portion of the shaft and upper portion of the shaft. Also integral with the upper part of the cylindrical plug, is a raised projection which cooperates with a cut-out portion of the end of the upper part of the hollow shaft when inserted over the upper part of the cylindrical plug. The projection and cut-out interact to provide accurate and consistent alignment between the upper portion of the shaft which include a grip and the lower portion of the shaft which includes the head. The final portion of the coupling mechanism includes a shaft which is inserted inside the upper portion of the hollow shaft. At the lower end of the shaft are external threads which cooperate with the internal threads of the upper part of the cylindrical plug. At the opposite end of the shaft is a knob or shoulder allowing for the shaft to be screwed into the upper part of the plug until the knob or shoulder bears against the upper part of the grip on the shaft providing for a tight coupling.

DETAILED DESCRIPTION OF THE INVENTION

Figure 1:
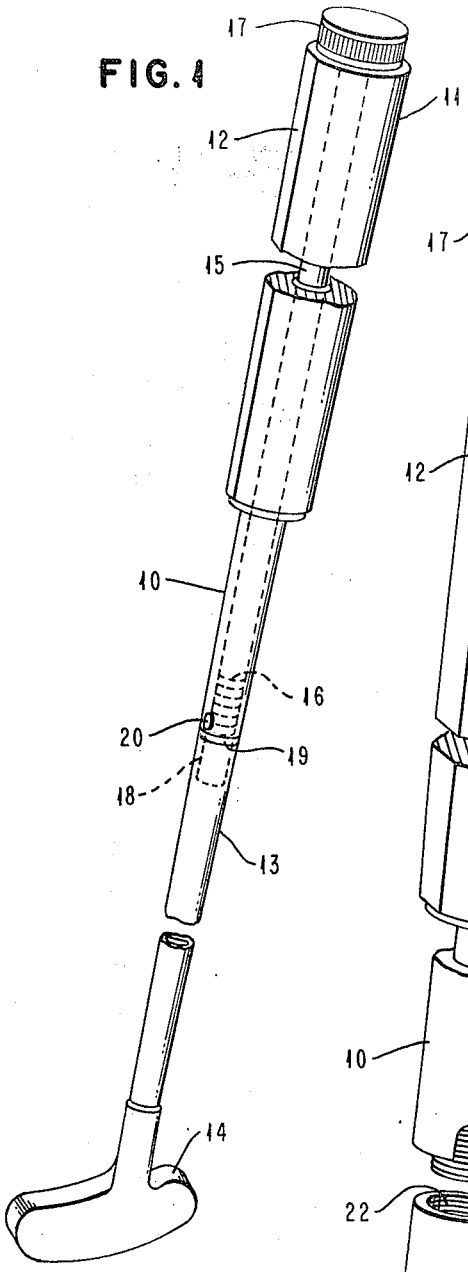
FIG. 1 is a perspective view of an assembled putter utilizing the coupling mechanism of the present invention.

FIG. 1 shows a golf club, and in particular a putter, incorporating the present invention. The club is comprised of a upper tubular section 10 including a grip 11 which includes a grip reminder in the form of a flat surface 12. The club also includes a lower tubular section 13 which has a club head 14 attached.

The coupling mechanism in accordance with the present invention includes a shaft 15 which has at its lower end external threads 16, and at its other end a knob or shoulder 17. The external threads 16 of the shaft 15 cooperate with a cylindrical plug inserted at 18 in the lower tubular section 13 and which includes internal threading to cooperate with the threads 16 of the shaft 15. Integral with the cylindrical plug 18 is a shoulder 19 which provides opposing surfaces abutting the lower tubular section 13 and upper tubular section 10. Also integral with the cylindrical plug 18 is an alignment projection 20 which cooperates with a cut-out portion of the end of the upper tubular section 10 shown in more detail in FIG. 2.

Figure 2:
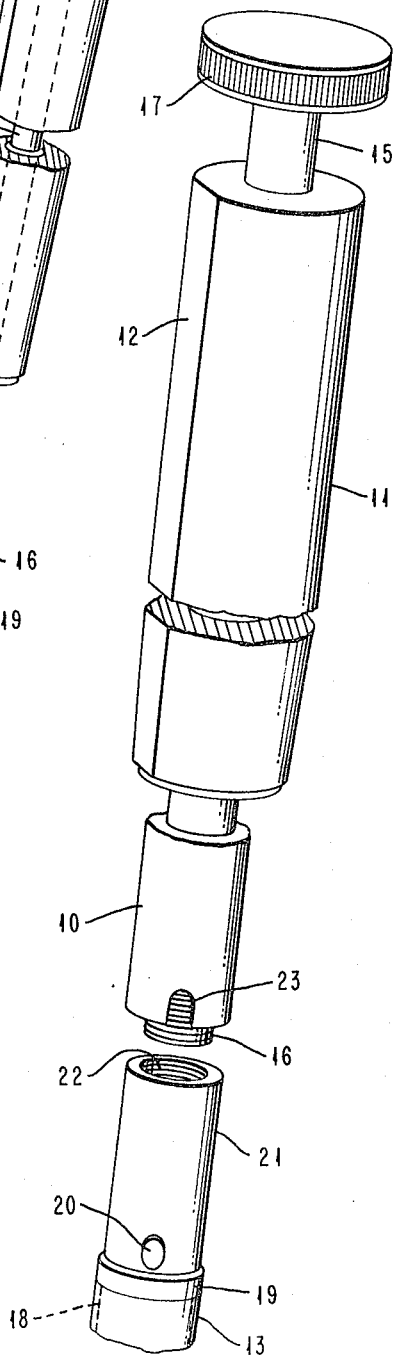
FIG. 2 is an enlarged perspective drawing of the coupler of the present invention in a dissassembled position.

In FIG. 2, the cylindrical plug 18 is shown inserted in the lower tubular section 13. The diameter of the cylindrical plug 18 is essentially the same as the inside diameter of tubular section 13 to provide a forced fit and/or a bonded connection to the tubular section 13 as a permanent connection.

In FIG. 2, an upper part 21 of the cylindrical plug 18 includes a pin made integral with the upper part 21 and which provides a raised projection 20 from the outer surface from the upper part 21. The upper part 21 of the cylindrical plug also includes internal threads 22 which cooperate with the external threads 16 of the shaft 15.

The cooperating cut-out portion of the upper tubular section 10, referred to generally in connection with FIG. 1, is shown at 23 in FIG. 2. Coupling of the upper tubular section 10 with the lower tubular section 13, with proper alignment between the surface 12 on the grip and the head 14 shown in FIG. 1, is effective by only longitudinal movement of the upper tubular section 10 over the upper part 21 of the cylindrical plug. Alignment is achieved by causing the cut-out portion 23 to slide into cooperative relationship with the projecting pin 20. Instead of a round projection 20 and U-shaped cut-out 23, other cooperating configurations are possible, such as a square and a rectangle.

Final coupling of the upper tubular section 10 to the lower tubular section 13 is effected by turning the knob or shoulder 17 of shaft 15 to cause the external threads 16 of the shaft to be screwed into the internal threads 22 of the upper part 21 of the cylindrical plug. The shoulder 19 at the mid-portion of the cylindrical plug provides an accurate bearing surface for the ends of the two tubular sections 10 and 13. Therefore, contact between these two relatively lightly constructed portions is not required to effect the coupling.

Figure 3:
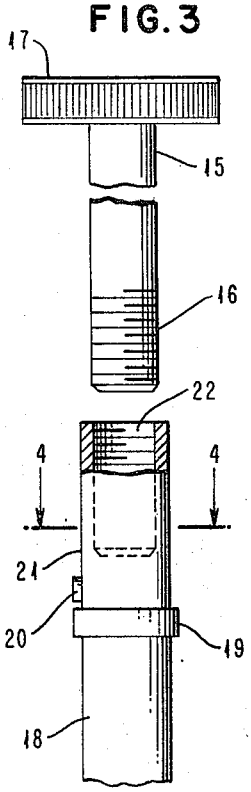
FIG. 3 is a side view of the coupler of the present invention.
Figure 4:
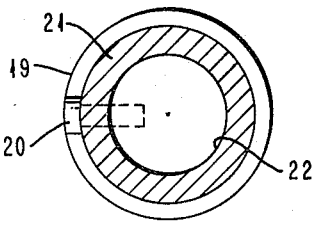
FIG. 4 is a cross section of the cylindrical plug of the present invention shown in FIG. 3.

In accordance with the coupling mechanism of the present invention as shown in FIGS. 3 and 4, it can readily be seen that a golf club or putter, which can be assembled or dissassembled, can be constructed from an ordinary production run of a completed putter. That is, any number of putters can be manufactured and a selected number chosen for adaptation for assembly and dissassembly. The completed shaft of the putter need only be cut at a proper point to permit a tight-fitting insertion of the lower part of the cylindrical plug 18 into the lower tubular section to a point where the end of the lower tubular section will abut against the shoulder 19.

The upper tubular section of the shaft then need only be provided with a cutout to cooperate with the raised projection provided by the pin 20. Also, the shaft 15, with external threads 16, is made of a length suitable to provide a tight fit by the knob or shoulder 17 bearing against the grip 11 when the shaft 15 is screwed into the internal threads 22 of the cylindrical plug.

There has thus been shown a coupling mechanism suitable for assembly or dissassembly of upper and lower tubular sections requiring only longitudinal motion between the two tubular sections, and wherein proper alignment between the two tubular sections is realized, and remains constant through continued assembly and dissassembly.

Having thus described my invention, what I claim as new, and desire to secure by Letters Patent is:

1. A golf club comprising:

upper and lower tubular sections wherein said upper tubular section has a grip at one end and said lower tubular section has a head at one end requiring a predetermined alignment with said grip;

a coupler including upper and lower parts, said lower part being inserted in said lower tubular section at the end opposite said head and said upper part being insertable in the lower end of said upper tubular section opposite said grip;

a shaft inserted in said upper tubular section including exterior threading at its lower end and a shoulder at its upper end;

said upper part of said coupler including interior threading cooperating with said exterior threading of the lower end of said shaft whereby coupling can be made by inserting said upper part of said coupler into the lower end of said upper tubular section and screwing said shaft into said coupler until said shoulder of said shaft is tight against said grip at the upper end of said upper tubular section; and aligning means including means integrally associated with said upper part of said coupler, and cooperating means associated with the lower end of said upper tubular section.

2. A golf club in accordance with claim 1 wherein:

said integral means associated with said upper part of said coupler includes a raised projection; and said cooperating means associated with the lower end of said upper tubular section includes a cut-out in the lower end of said upper tubular section conforming to the shape of said raised projection on said upper part of said coupler.

3. A golf club in accordance with claim 2 wherein:

said projection is circular; and said cooperating cut-out is U-shaped.

4. A golf club in accordance with claim 3 wherein said coupler includes:

a shoulder providing upper and lower surfaces abutting against the lower end of said upper tubular section and upper end of said lower tubular section respectively.

* * * * *